US008516735B2

(12) United States Patent
Ilacqua

(10) Patent No.: US 8,516,735 B2
(45) Date of Patent: Aug. 27, 2013

(54) ADJUSTMENT MECHANISM FOR FIREARM SCOPE ZOOM

(76) Inventor: Anthony Ilacqua, Rochester, NY (US)

( * ) Notice: Subject to any disclaimer, the term of this patent is extended or adjusted under 35 U.S.C. 154(b) by 0 days.

(21) Appl. No.: 13/351,068

(22) Filed: Jan. 16, 2012

(65) Prior Publication Data

US 2013/0180154 A1 Jul. 18, 2013

(51) Int. Cl.
*F41G 1/38* (2006.01)

(52) U.S. Cl.
USPC ..... 42/119; 42/85; 42/90; 42/143

(58) Field of Classification Search
USPC ..... 42/119, 122; 16/414, 417, 430, 16/441, 442
See application file for complete search history.

(56) References Cited

U.S. PATENT DOCUMENTS

| | | | | | |
|---|---|---|---|---|---|
| 1,803,375 | A | * | 5/1931 | Adams | 292/347 |
| 2,913,826 | A | | 11/1959 | Petty | |
| 3,492,733 | A | | 2/1970 | Leatherwood | |
| 3,782,822 | A | | 1/1974 | Spence | |
| 3,902,251 | A | * | 9/1975 | Ross | 42/122 |
| D264,851 | S | * | 6/1982 | Huckenbeck | D16/134 |
| 4,856,140 | A | * | 8/1989 | Visco et al. | 16/412 |
| D308,981 | S | * | 7/1990 | Moore | D16/132 |
| D308,982 | S | * | 7/1990 | Moore | D16/132 |
| D313,607 | S | * | 1/1991 | Moore | D16/132 |
| 5,180,875 | A | | 1/1993 | Berry, Jr. et al. | |
| 5,194,987 | A | | 3/1993 | Moore et al. | |
| 5,223,650 | A | * | 6/1993 | Finn | 42/122 |
| D342,537 | S | * | 12/1993 | Olson | D16/136 |
| 5,276,554 | A | * | 1/1994 | Nassivera | 359/694 |
| 5,521,757 | A | * | 5/1996 | Olson | 359/425 |
| 5,924,211 | A | | 7/1999 | Wambold, Jr. et al. | |
| 6,226,880 | B1 | | 5/2001 | Pitre | |
| 6,508,026 | B1 | * | 1/2003 | Uppiano et al. | 42/119 |
| 7,246,461 | B2 | | 7/2007 | Wooden | |
| D553,716 | S | * | 10/2007 | Lockard | D23/259 |
| 7,552,559 | B2 | | 6/2009 | Day | |
| D600,546 | S | * | 9/2009 | Scilingo et al. | D8/397 |
| 7,636,210 | B1 | * | 12/2009 | Liang | 359/823 |
| 7,684,114 | B2 | | 3/2010 | Thomas | |
| D619,193 | S | * | 7/2010 | Riley | D22/108 |
| 7,836,626 | B2 | * | 11/2010 | Shepherd | 42/130 |
| D631,121 | S | * | 1/2011 | Cheng | D22/108 |
| 7,997,163 | B2 | * | 8/2011 | Casas | 74/553 |
| 8,116,007 | B2 | * | 2/2012 | Tsai | 359/634 |
| 8,166,697 | B1 | * | 5/2012 | Sueskind | 42/125 |

* cited by examiner

*Primary Examiner* — Bret Hayes
*Assistant Examiner* — Derrick Morgan
(74) *Attorney, Agent, or Firm* — Katherine H. McGuire, Esq.; Woods Oviatt Gilman, LLP

(57) ABSTRACT

A mechanism for adjusting the zoom of a firearm scope includes an elongated, generally cylindrical body which may be formed integral with or as a separate component for attaching to the zoom ring. A plurality of annularly spaced openings or fins are formed on the body and extend between the proximal (close to the shooter) and distal ends thereof. The length of the body is such that at least one of the openings or fins is always present adjacent the thumb rest area of the firearm (e.g., rifle) handle. As such, a shooter need only move their trigger hand thumb to reach and engage an opening or fin to rotate the body which causes simultaneous rotation of the zoom ring.

16 Claims, 7 Drawing Sheets

ADJUSTMENT MECHANISM FOR FIREARM SCOPE ZOOM

BACKGROUND OF THE INVENTION

The present invention relates to telescopic sights, and more particularly relates to an adjustment mechanism for the zoom of a firearm scope.

Firearm scopes are well known telescopic sight mechanisms which are mounted to the top of a firearm (e.g., rifle, shot gun, hand gun, etc.) to allow the shooter to view distant objects for greater shooting accuracy. Many scopes include the ability to adjust the optical magnification via a rotatable ring which may be rotated by the shooter to set the desired magnification. The rotatable ring is typically located in a position which requires the shooter to take one hand off the firearm so that they may reach and rotate the ring while simultaneously looking through the scope eyepiece for visual feedback while adjusting the magnification. Having to take a hand off the firearm during this process is undesirable in several respects. For example, when hunting with a rifle or shotgun, once the target has been acquired, any movement of the hand off and then back on the rifle or shotgun can also move the firearm off the target and decrease shooting accuracy. Any movement also has the potential of visually and/or audibly altering prey that may then run before the shooter has a chance to fire the shot. The following are some examples of prior art mechanisms for adjusting the zoom of a firearm scope:

U.S. Pat. No. 2,913,826 issued on Nov. 24, 1959 to Petty
U.S. Pat. No. 3,492,733 issued on Feb. 3, 1970 to Leatherwood
U.S. Pat. No. 3,782,822 issued on Jan. 1, 1974 to Spence
U.S. Pat. No. 5,180,875 issued on Jan. 19, 1993 to Berry, Jr. et al
U.S. Pat. No. 5,194,987 issued on Mar. 16, 1993 to Bausch & Lomb Incorporated
U.S. Pat. No. 5,276,554 issued on Jan. 4, 1994 to Nassivera
U.S. Pat. No. 5,521,757 issued on May 28, 1996 to Olson
U.S. Pat. No. Des. 342,537 issued on Dec. 21, 1993 to Olson
U.S. Pat. No. 5,924,211 issued on Jul. 20, 1999 to Wambold, Jr., et al
U.S. Pat. No. 6,226,880 issued on May 8, 2001 to Pitre
U.S. Pat. No. 7,246,461 issued on Jul. 24, 2007 to Wooden
U.S. Pat. No. 7,552,559 issued on Jun. 30, 2009 to Day
U.S. Pat. No. 7,684,114 issued on Mar. 23, 2010 to Thomas While the above patents illustrate various mechanisms which are used in conjunction with a firearm scope zoom, each have drawbacks including, for example, a complex design which translates into a high cost to manufacture, dependency on right or left hand use, complicated installation and use, and designs which are susceptible to being easily damaged. There therefore remains a need for an improved mechanism for adjusting the zoom of a firearm scope which overcomes the drawbacks of the prior art.

SUMMARY OF THE INVENTION

The present invention addresses the above need by providing a mechanism for adjusting the zoom of a firearm scope which is relatively simple in design and thus low in cost yet is extremely robust and easy to use in that the shooter need only move the thumb of the trigger hand (irrespective as to whether the left or right hand is the trigger hand) to reach and adjust the zoom adjustment mechanism.

More particularly, in one aspect, the invention comprises an adjustment mechanism for a firearm scope zoom which may be integrally formed with the zoom ring or provided as a separate component that may be removably attached to the zoom ring of a firearm scope. The adjustment mechanism includes a substantially cylindrical body having a longitudinal axis extending between opposite proximal and distal ends. The distal end of the adjustment mechanism is attached to the firearm scope zoom ring in rotationally fixed relation thereto such that rotation of said cylindrical body about its longitudinal axis causes simultaneous rotation of the zoom ring. The cylindrical body proximal end extends rearwardly (toward the shooter) to a position adjacent the trigger hand thumb rest area of the firearm. A plurality of thumb engagement features are provided in annularly spaced relation about the cylindrical body. In one embodiment, a plurality of openings are formed through and annularly spaced about the cylindrical body, the spacing between the openings being such that at least one of the openings is always located within reach of the shooter's trigger thumb when the user's trigger hand in on the firearm regardless of the rotational position of the adjustment mechanism on the firearm (this relative positioning of the thumb engagement feature to the trigger hand thumb is referred to herein as the "ergonomic" positioning of the thumb engagement features). As such, a shooter of the firearm may, with their trigger hand holding the firearm and the shooter's index finger on the trigger, move their trigger hand thumb from the trigger thumb rest area to reach and engage the wall defining an adjacent one of the openings in the cylindrical body and rotate the adjustment mechanism and thus also the zoom ring which in turn adjusts the zoom (scope magnification). In another embodiment the openings do not extend entirely through the cylindrical body forming what may be considered as depressions.

In yet another embodiment of the invention, the cylindrical body includes thumb engagement features in the form of a plurality of fins extending radially outwardly therefrom in annularly spaced relation thereabout. The fins may be configured in a variety of geometries and in one embodiment the fins extend parallel to the longitudinal axis of the cylindrical body and may taper further radially outwardly in the direction from the distal end to the proximal end. In yet another embodiment, the fins extend in a non-parallel fashion along the cylindrical body and may be configured in an angled or spiral manner. In still a further embodiment of the invention, the thumb engagement feature is a combination of openings and/or depressions and/or fins.

Due to the different size firearms, scopes, scope mounting positions on the firearm and the hand size of the shooter, the dimensions of the cylindrical body and the thumb engagement features thereon may vary as desired in order to achieve the most effective transmission of force from the shooter's thumb to the rotatable adjustment mechanism.

DETAILED DESCRIPTION OF PREFERRED EMBODIMENTS

Figure 1:
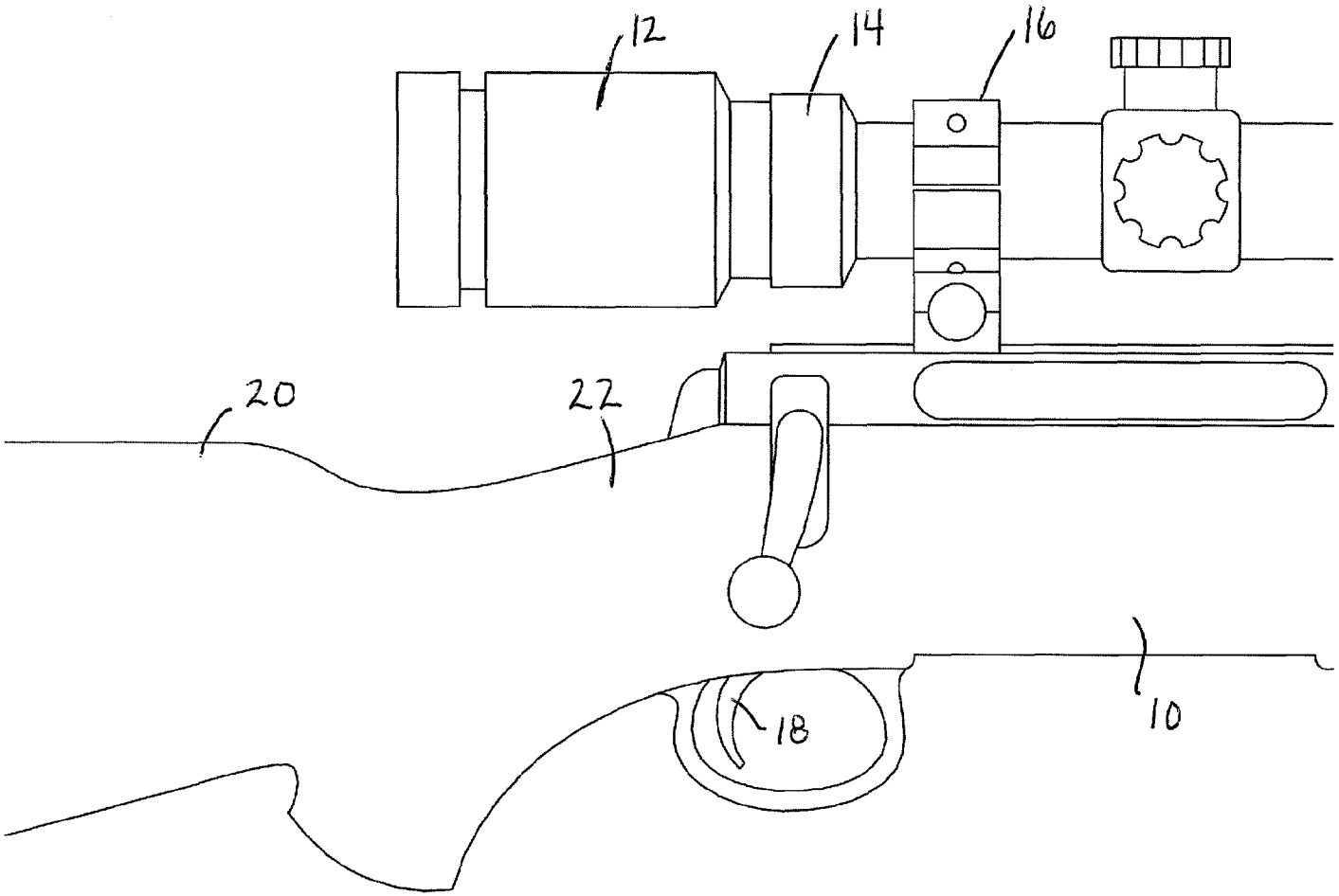
FIG. 1 (PRIOR ART)
FIG. 1 is a fragmented side elevation view of a rifle showing the trigger area with a prior art rifle scope mounted thereto.

FIG. 1 illustrates an exemplary firearm in the form of a prior art rifle 10 (fragmented) having a prior art rifle scope 12 with manually adjustable zoom ring 14 attached to rifle 10 via mounting assembly 16. Rifle 10 includes a trigger 18 located forwardly (in the distal direction) of handle 20. It is understood that although a rifle is shown for the sake of description, the invention is not limited to a rifle scope and is applicable to any type of firearm having an adjustable scope. In normal operation a shooter or user would grasp the rifle with their trigger hand and have their trigger hand index finger on the trigger 18 and trigger hand thumb resting in thumb rest area 22. It is evident that the user would not normally be able to reach zoom ring 14 to adjust focus of scope 12 with their trigger hand without removing their trigger hand finger from the trigger. Alternatively, the user will keep their trigger hand index finger on the trigger and adjust zoom ring 14 by using their opposite hand (which must be moved from the normal holding and supporting grasp of the forearm, stock or barrel of the rifle when in a firing stance). As stated above, either movement is undesirable when in a firing stance as any such movement may move the rifle off target and/or cause visual and audible cues which may alert the intended prey who may then attempt escape prior to the user (hunter, in this instance) firing the shot.

Figure 2A:
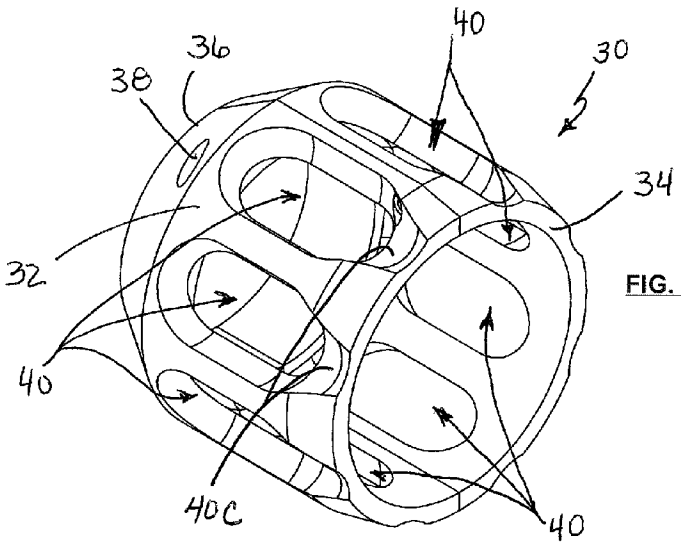
FIGS. 2A-2D are perspective, side elevation, proximal end and distal end views, respectively, of one embodiment of the invention.
Figure 2D:
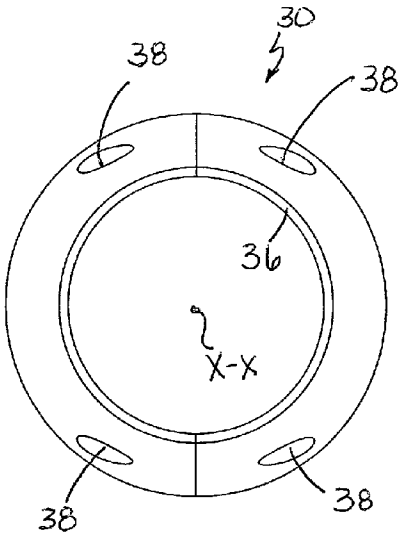
Figure 2C:
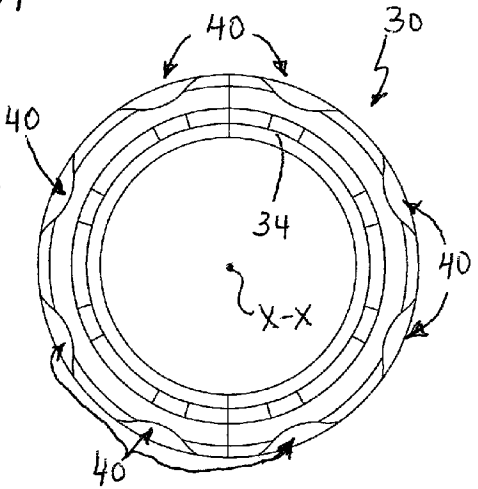
Figure 2B:
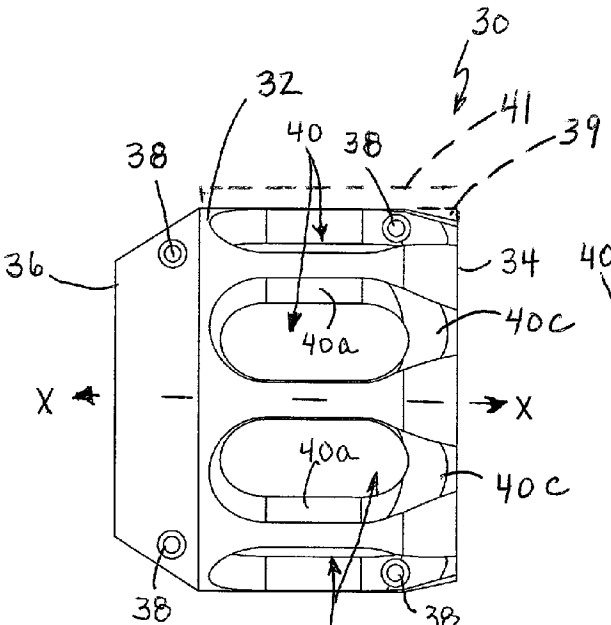
Figure 3:
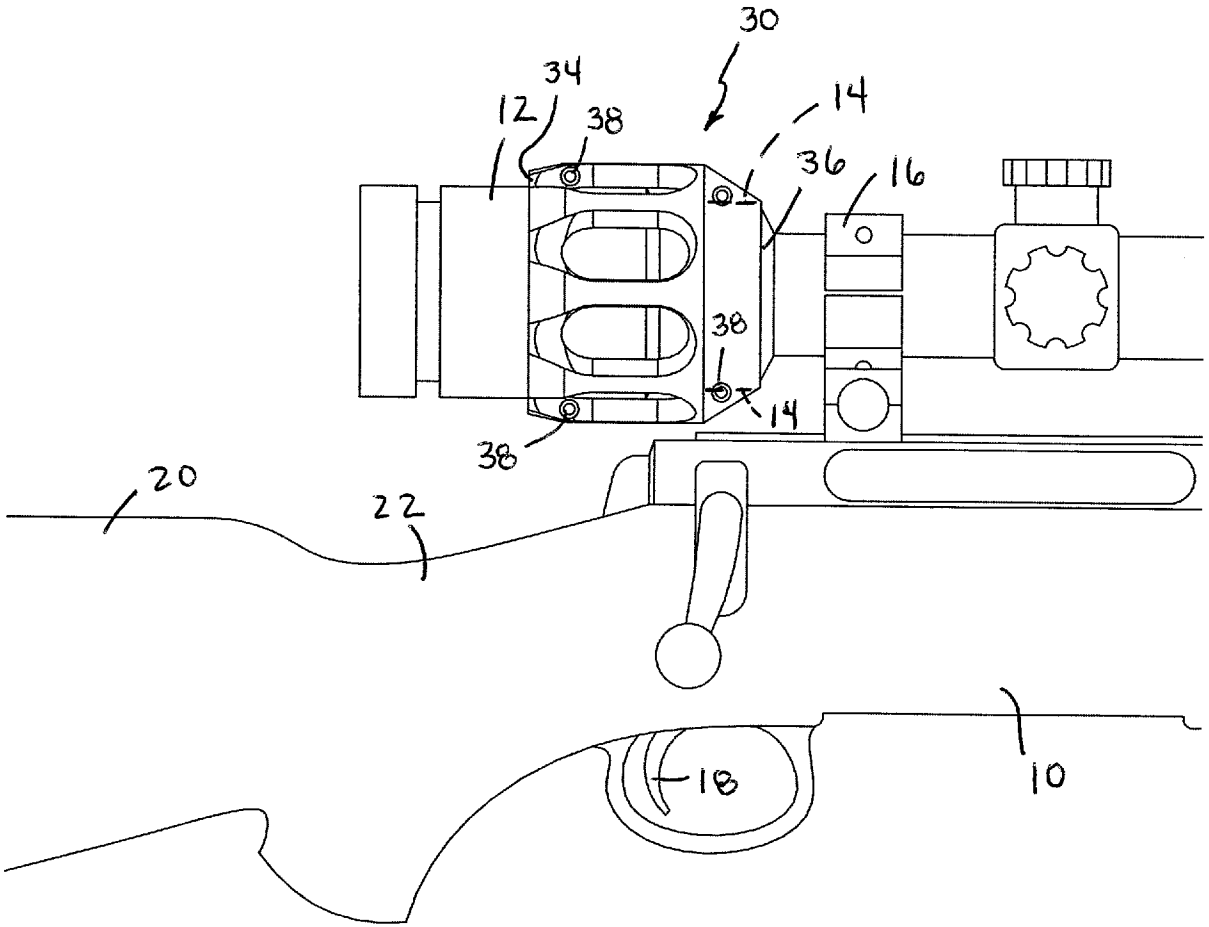
FIG. 3 the view of FIG. 1 showing the embodiment of FIGS. 2A-2D mounted to the rifle scope zoom ring in the intended manner.

FIGS. 2A-2D illustrate one preferred embodiment of the zoom adjustment mechanism of the invention which is indicated generally by the reference numeral 30. Mechanism 30 is seen to include a substantially cylindrical body 32 extending along a longitudinal axis X-X and between opposite proximal and distal ends 34 and 36, respectively. In the embodiment shown, mechanism 30 is formed as a separate part that may be attached to a prior art firearm scope such as scope 12 as seen in FIG. 3. For example, mechanism 30, which may be made of any desirable and appropriate material (e.g., plastic, aluminum, stainless steel, etc.), may be formed in two longitudinal halves which are assembled about the zoom ring and secured together via screws 38, for example. Other attachment configurations allowing such separate attachment (and removal, if desired) are of course possible and within the scope of the invention (e.g., a mechanism made of two plastic halves interconnected by a longitudinally extending living hinge with securing tabs or clasps). In another embodiment of the invention, the adjustment mechanism may be integrally formed with the zoom ring 14.

Figure 4:
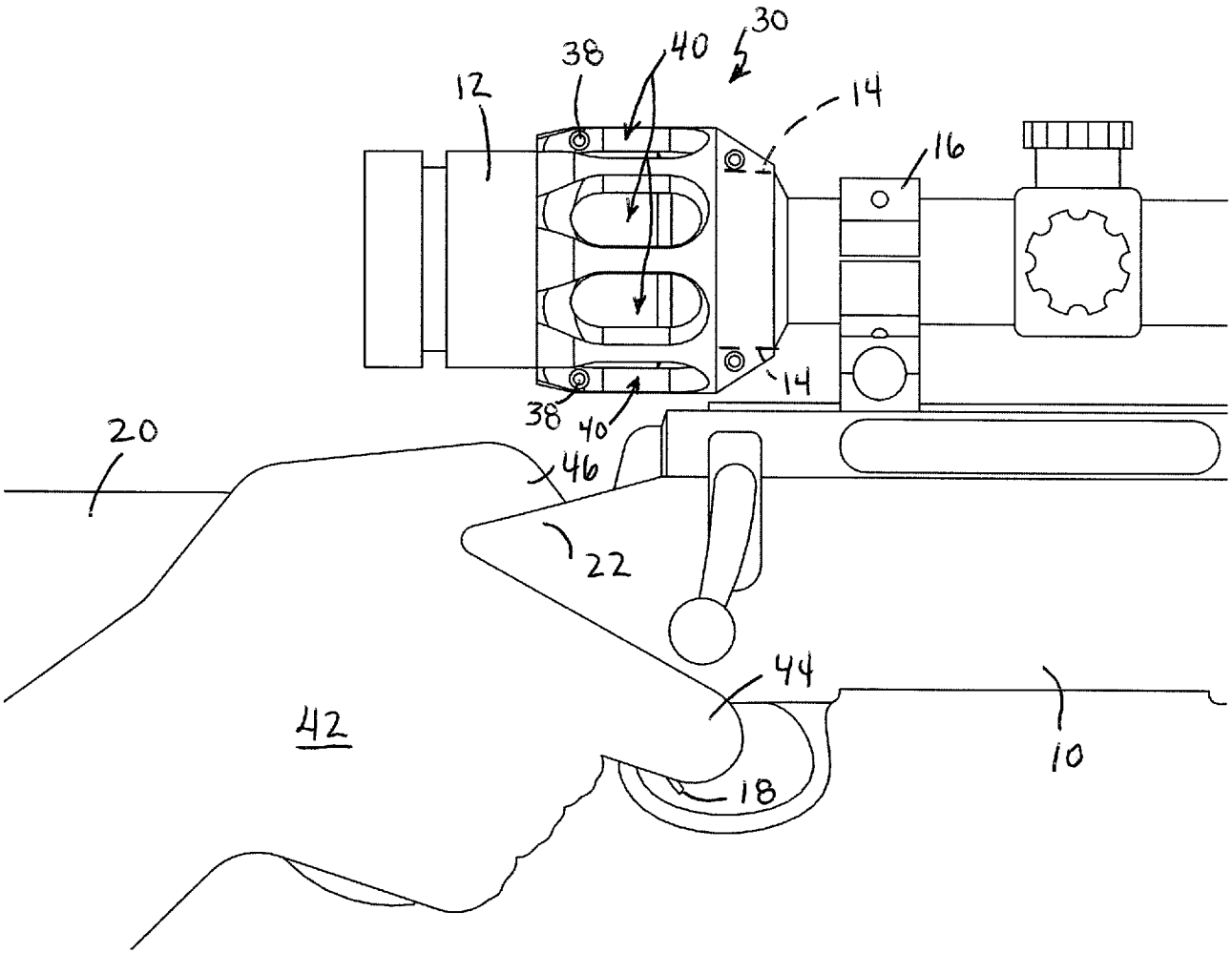
FIG. 4 is the view of FIG. 3 showing a user's trigger hand grasping the rifle with the user's trigger hand index finger on the trigger and the user's trigger hand thumb resting on the butt of the rifle.
Figure 5:
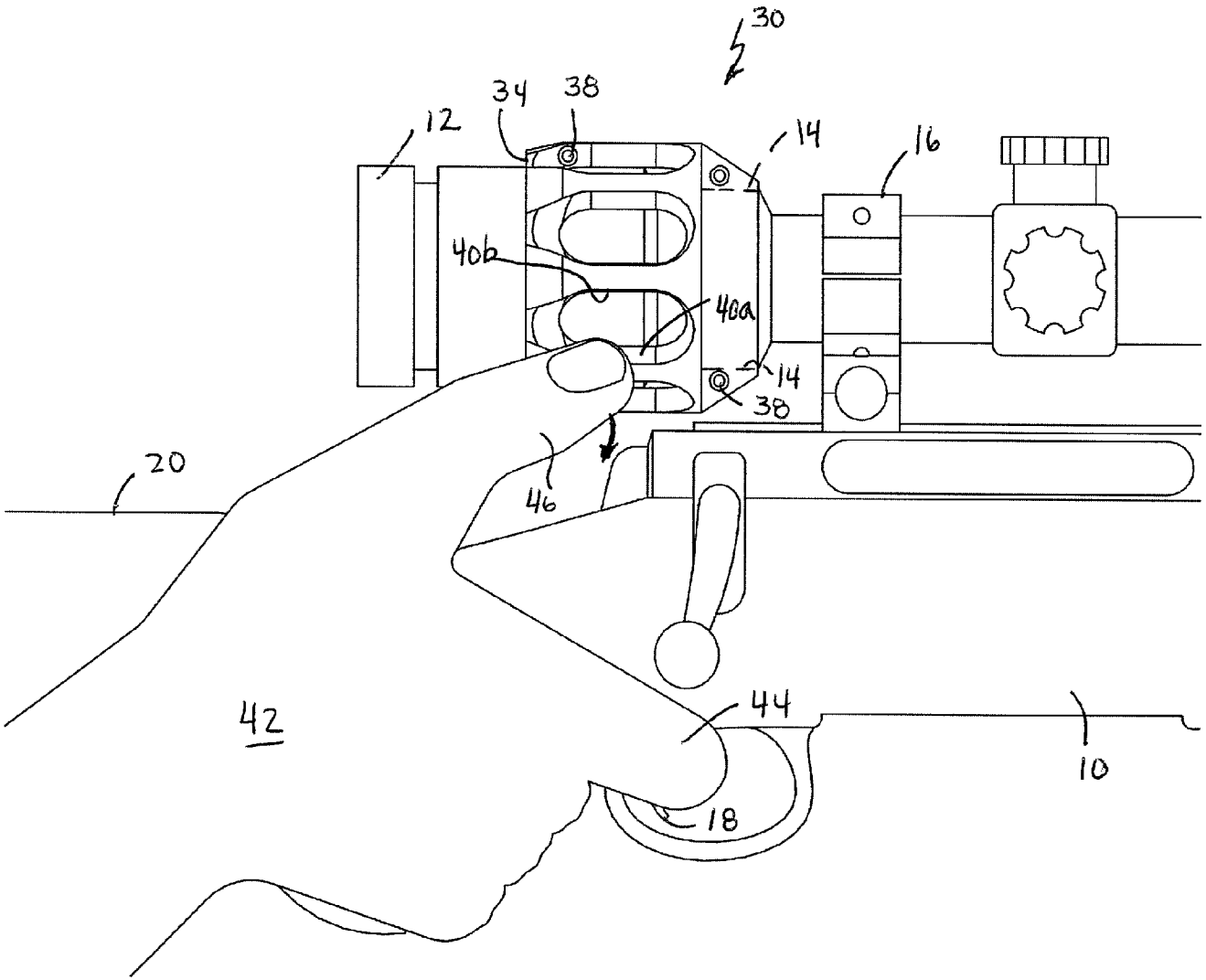
FIG. 5 is the view of FIG. 4 showing the user's trigger hand thumb moved to engage one of the openings in the zoom ring adjustment mechanism with the user's trigger hand index finger remaining on the trigger.
Figure 6A:
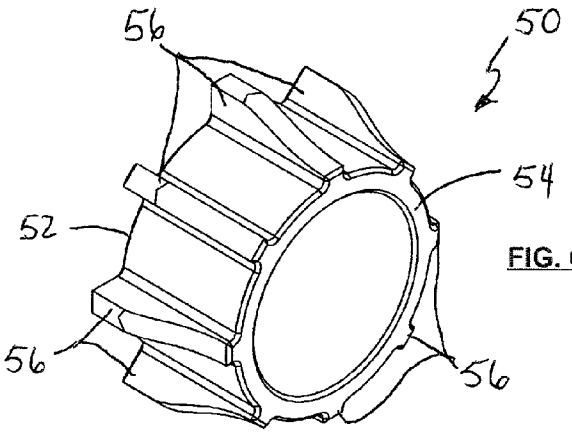
FIGS. 6A-6D are distal end, proximal end, side elevation and perspective views, respectively, of another embodiment of the invention.
Figure 6D:
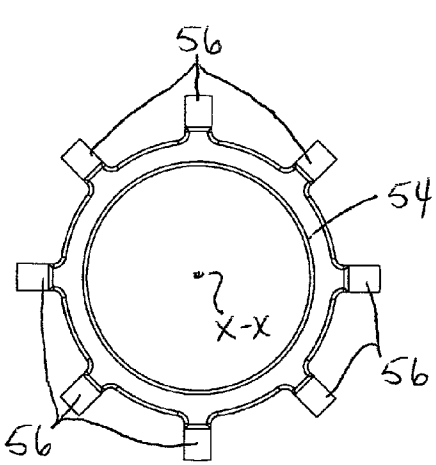
Figure 6C:
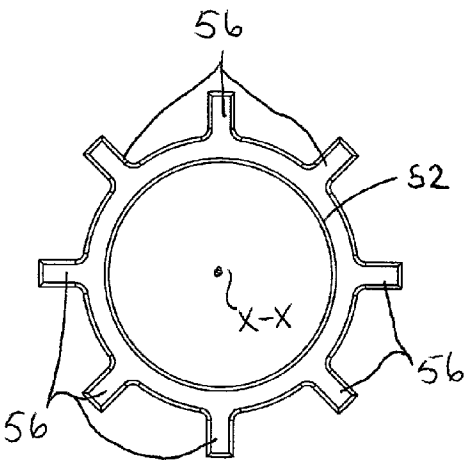
Figure 6B:
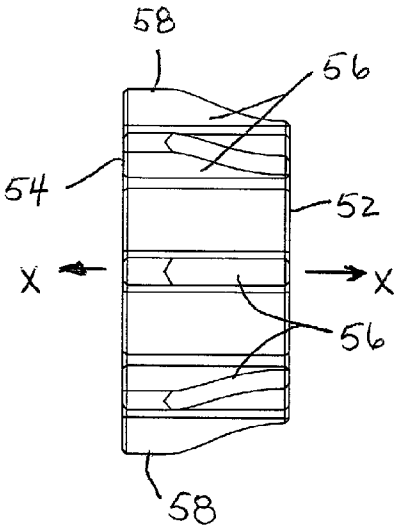

As seen in FIGS. 2A-2D and also FIGS. 3-5, adjustment mechanism 30 includes at least one, but preferably a plurality of annularly spaced thumb engagement features which, in this embodiment, take the form of openings 40 formed through cylindrical body 32. Openings 40 are defined by a side wall 40*a* and configured to allow a user to engage any adjacent opening 40 with their trigger hand thumb to adjust zoom ring 14. More particularly, as seen in FIG. 4, a user's trigger hand 42 is grasping rifle 10 in the intended manner when ready to fire, i.e., trigger hand index finger 44 is on trigger 18 and trigger hand thumb 46 extends to the thumb rest area 22. The other and (not shown) is typically holding and supporting the forearm, stock or barrel of the rifle. With the aid of the invention, should the user need to adjust scope 12, the user simply raises their trigger hand thumb 46 and engages the side wall of the closest opening 40 and presses in an upward or downward direction (toward trigger 18) causing mechanism 30 to rotate and thus also zoom ring 14 to which mechanism 30 is rotationally fixed. Pressing the thumb in the upward direction against opposite opening side wall (labeled 40*b* in FIG. 5) rotates mechanism 30 in the opposite direction and in this way the user may finely adjust the focus with only small motions of the thumb in either direction. It is noted opening side wall 40*a* may optionally taper in a direction toward longitudinal axis X-X which presents more side wall surface area to the thumb which optimizes the transmission of force from the thumb to the adjustment mechanism engagement. The angle of taper may vary as required to achieve the most effective ergonomic positioning of the thumb engagement features for the particular firearm, scope and shooter as described above.

It is understood that while openings 40 are shown as being elongated in the direction of longitudinal axis X-X, openings 40 may be provided in one or a combination of various outline geometries (e.g., circular, rectangular, triangular, etc.). Also, although openings 40 are shown as extending entirely through the cylindrical body 32, it is understood that they may instead be formed as depressions which do not extend all the way through the cylindrical body 32. In the embodiment shown, openings 40 are spaced to ensure one of the openings 40 will always be presented for engagement by the user's trigger hand thumb 46 regardless of the rotational starting point of mechanism 30. The thumb engagement feature may extend all the way to proximal end surface 34 and may take the form of a concavity 40*c* which provides additional surface area for thumb engagement. As seen in FIG. 2B, the concavity 40*c* may taper inwardly or may alternatively include a wall segment 39 as indicated in dotted line which may provide further thumb engagement surface area.

Another embodiment of the invention is seen in FIGS. 6A-6D to include a generally cylindrical body 50 having proximal and distal ends 52, 54, respectively, extending between a longitudinal axis X-X.

The distal end may be integrally formed with or adapted to be attached to the rifle scope zoom ring as discussed above with regard to body 30. The body 50 will be in rotationally fixed relation to the zoom ring such that rotation of the cylindrical body 50 about its longitudinal axis causes rotation of the zoom ring, the proximal end 52 extending to a position adjacent the trigger hand thumb rest area. A plurality of thumb engagement features in the form of fins 56 are formed in annularly spaced about cylindrical body 50, the spacing being such that at least one of the fins is located within reach of a user's trigger thumb when the user's trigger hand in on the rifle. As such, a user of said rifle may, with their trigger hand holding the rifle with the user's index finger on the trigger, move their trigger hand thumb from the trigger thumb rest area to reach and engage an adjacent one of the fins 56 on cylindrical body 50 and rotate adjustment mechanism 50 and thus also the zoom ring without removing the user's trigger index finger from the trigger.

In the embodiment of FIGS. 6A-6D, the plurality of fins are elongated and extend parallel to the longitudinal axis X-X of cylindrical body 50. The fins may taper outwardly in a direction toward the proximal end 52. Each fin 56 may also include a segment 58 located adjacent proximal end 52, the segment 58 extending substantially parallel to longitudinal axis X-X.

Figure 7B:
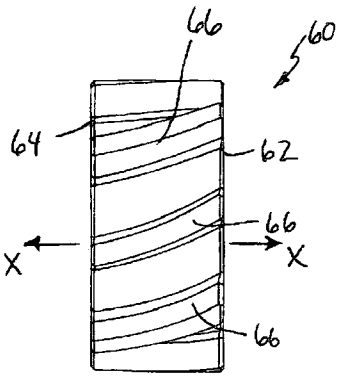
FIGS. 7A-7C are proximal end, side elevation and perspective vies, respectively, of another embodiment of the invention.
Figure 7A:
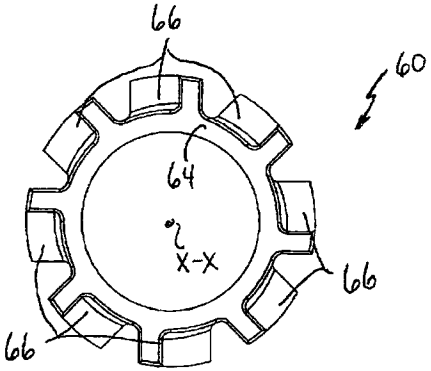
Figure 7C:
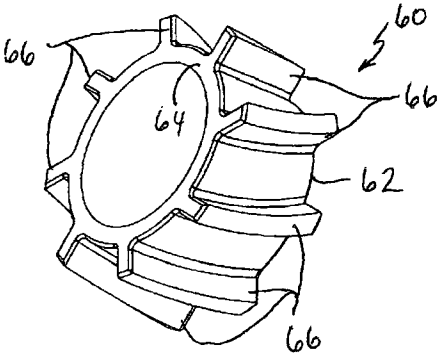

In the embodiment of FIGS. 7A-7C, the plurality of fins 66 are elongated and extend in a non-parallel fashion with respect to the longitudinal axis X-X of said cylindrical body, and may extend in a spiral fashion about the cylindrical body. The angle or pitch of the fins may vary as desired to optimize the ergonomically positioning of the thumb engagement features for the particular firearm, scope and shooter as described above. As with the other embodiments, the fins 66 may be equally spaced about the cylindrical body.

It is noted that yet another embodiment of the invention may include a combination of openings and fins. As seen in FIG. 2B, fins 41 as indicated in dotted line may be formed between each opening (or depression) 40. As described above, the thumb engagement features may be of any desired combination, geometries and dimensions so long as the features function to present a surface area against which the shooter may press and engage their trigger hand thumb to rotate the adjustment mechanism without the shooter having to take their trigger hand off the trigger.

Although the invention has been described with reference to preferred embodiments thereof, it is understood that various modifications may be made thereto without departing from the full spirit and scope of the invention as defined by the claims which follow.

What is claimed is:

1. An adjustment mechanism for a firearm scope, the firearm scope having a zoom ring, said firearm scope adapted to be mounted to a firearm and the firearm having a trigger and trigger hand thumb rest area, said adjustment mechanism comprising:

a) a substantially cylindrical body having a longitudinal axis extending between opposite proximal and distal ends, said distal end configured to be attached to said rifle scope zoom ring in rotationally fixed relation thereto such that rotation of said cylindrical body about its longitudinal axis causes rotation of said zoom ring, said proximal end extending in covering relation to an ocular housing of said scope to a position adjacent said trigger hand thumb rest area of said firearm when said firearm scope is mounted to said firearm; and b) a plurality of thumb engagement features formed on and annularly spaced about said cylindrical body, said spacing being such that at least one of said thumb engagement features is located within reach of a user's trigger thumb when the user's trigger hand is holding the firearm with the user's index finger on the trigger and regardless of the rotational starting point of said cylindrical body with respect to said firearm;

wherein a force applied solely by the trigger hand thumb against said at least one thumb engagement features provides sufficient force to rotate said adjustment mechanism, and thus also said zoom ring, without requiring removal of the user's trigger index finger from said trigger.

2. The adjustment mechanism of claim 1 wherein said cylindrical body distal end is integrally formed with said zoom ring.

3. The adjustment mechanism of claim 1 wherein said thumb engagement features comprise openings formed through said cylindrical body wherein said openings are defined by one or more side walls.

4. The adjustment mechanism of claim 3 wherein said plurality of openings are elongated and extend parallel to the longitudinal axis of said cylindrical body.

5. The adjustment mechanism of claim 3 wherein said openings are equally spaced about said cylindrical body.

6. The adjustment mechanism of claim 3 wherein said side walls of said openings each taper inwardly toward the longitudinal axis of said cylindrical body.

7. The adjustment mechanism of claim 3 wherein said openings extend closer to said proximal end than to said distal end.

8. The adjustment mechanism of claim 1 wherein said thumb engagement features comprise a plurality of fins formed on said cylindrical body.

9. The adjustment mechanism of claim 8 wherein said cylindrical body distal end is integrally formed with said zoom ring.

10. The adjustment mechanism of claim 8 wherein said plurality of fins are elongated and extend parallel to the longitudinal axis of said cylindrical body.

11. The adjustment mechanism of claim 8 wherein said plurality of fins are elongated and extend in a non-parallel fashion with respect to the longitudinal axis of said cylindrical body.

12. The adjustment mechanism of claim 8 wherein said plurality of fins extend in a spiral fashion about said cylindrical body.

13. The adjustment mechanism of claim 8 wherein said fins are equally spaced about said cylindrical body.

14. The adjustment mechanism of claim 8 wherein said fins taper radially outwardly in a direction toward said proximal end.

15. The adjustment mechanism of claim 14 wherein each said fin includes a segment located adjacent said proximal end, said segment extending substantially parallel to said longitudinal axis.

16. The adjustment mechanism of claim 8 wherein said thumb engagement features further comprise openings formed though said cylindrical body between said fins.

* * * * *